US005989081A

United States Patent [19]

Lekhtman

[11] Patent Number: 5,989,081

[45] Date of Patent: Nov. 23, 1999

[54] PEDAL BOAT

[75] Inventor: David Lekhtman, Beaconsfield, Canada

[73] Assignee: Step Jet Corporation, St. Laurent, Canada

[21] Appl. No.: 09/059,433

[22] Filed: Apr. 14, 1998

[51] Int. Cl.[6] ..... B63H 16/20

[52] U.S. Cl. ..... 440/27; 440/90

[58] Field of Search ..... 440/26, 27, 30, 440/90–92; 416/131, 206, 207; 415/6; 290/54

[56] References Cited

U.S. PATENT DOCUMENTS

| | | | |
|---|---|---|---|
| 646,041 | 3/1900 | Sheen . | |
| 3,083,677 | 4/1963 | Deubelbeiss | 440/27 |
| 4,140,076 | 2/1979 | Borglum | 440/27 |
| 4,668,196 | 5/1987 | Billmayer et al. | 440/26 |
| 5,071,378 | 12/1991 | Wang | 440/90 |
| 5,110,313 | 5/1992 | Po | 440/90 |

*Primary Examiner*—Jesus D. Sotelo
*Attorney, Agent, or Firm*—Foley & Lardner

[57] ABSTRACT

A pedal boat comprises an integrally molded hollow hull having an upper surface where water passengers can be seated. The hull is provided with drain holes to conduct water away from the pedal boat. A steering assembly and paddle wheel assembly are mounted to the hull. Each paddle of the paddle wheel assembly has a terminal portion which is displaceable between a rest position, wherein the terminal portion extends at an angle to the plane of the paddle to provide a more vertical entrance angle of the paddle in the water, thereby reducing the noise factor, and a loaded position in the water, wherein the terminal portion extends in the plane of the paddle to provide a greater thrust.

21 Claims, 8 Drawing Sheets

PEDAL BOAT

BACKGROUND OF THE INVENTION

1. Field of the Invention

The present invention relates to a pleasure boat and, more particularly, pertains to a new an improved pedal boat construction.

2. Description of the Prior Art

A pedal boat normally has a hull which is formed of two associated molded shells secured together so as to provide a floating platform which is adapted to carry two or more passengers.

One problem associated with this type of hull is that water tends to enter in the hull by the seams thereof, thereby affecting the integrity and durability of the hull. There is thus a need for a seamless unitized hull construction which will eliminate water leakage.

Additionally, conventional hulls must be bailed out as any other boat. Therefore, a self-bailing hull which is adapted to drain the water from the cock-pit is desirable.

Over the years, various paddle design have been developed in order to obtain more efficient arrangements to propel non-motorized pleasure boat. For instance, U.S. Pat. No. 646,041 issued on Mar. 27, 1900 discloses a rowing device which is adapted to be mounted to a boat. The rowing device comprises a paddle which can be pivoted between an open and a folded position by operation of a lever mechanism connected therewith. The paddle is displaced in a folded position during the return movement of the paddle in order to minimize the surface exposed to wind-pressure, as well as to prevent striking the water.

U.S. Pat. No. 5,071,378 issued on Dec. 10, 1991 to Wang discloses a boat impeller wheel comprising a rotating shaft and a plurality of vane units extending radially therefrom. According to one preferred embodiment, each vane unit includes a planar main plate having a leading surface and a trailing surface from which extends a pair of lugs. A planar swing plate is pivotally mounted to the lugs of the main plate with the center of gravity of the swing plate being located between the rotating shaft and the pivot axis of the swing plate, such that when a vane unit leaves the surface of the water, the swing plate thereof pivots away from the trailing surface of the main plate to permit water on the vane unit to flow back into the water along the swing plate, thereby reducing the splashing of water therefrom.

However, the above-described paddle constructions are somewhat noisy because the paddles thereof slap the surface of the water as they enter it. Moreover, they are not configured to store energy in order to further propel the boat.

Efforts have also been made to find better ways of assembling paddle wheels or blade assemblies. For instance, U.S. Pat. No. 5,110,313 issued on May 5, 1992 to Po discloses a separable blade assembly for a rubber raft which comprises two blade members and two crankshaft members. Each blade member includes a hub and two diametrically opposed blades extending therefrom. The blades are provided at an inner end thereof with a protrusion which is adapted to fit within a radial groove defined on the hub of the other blade member. The crankshaft members can be inserted through a central hole defined in the hubs of the aligned blade members, respectively. A bolt secures the two blade members and the two crankshaft members in a solid crankshaft blade assembly.

Although the blade assembly described in the above-mentioned patent is effective, it has been found that there is a need for a new and improved paddle wheel assembly.

SUMMARY OF THE INVENTION

It is therefore an aim of the present invention to provide a pedal boat which has an integrally molded hollow hull.

It is a further aim of the present invention to provide a hull which is self-bailing.

It is a further aim of the present invention to provide a hull which has a great stability.

It is a further aim of the present invention to provide a pedal boat having adjustable backrests mounted thereon.

It is a further aim of the present invention to provide a pedal boat having a new and improved paddle wheel construction for increased performances and a quieter operation.

It is a further aim of the present invention to provide such a paddle wheel construction which is designed for offering ease of assembly, disassembly and repair.

Therefore, in accordance with the present invention, there is provided a paddle wheel for propelling a boat in water comprising a hub means and a plurality of propulsion members. Each propulsion member has a first portion thereof extending along a radial axis from the hub means and a second portion displaceable between a first position wherein the second portion extends at an angle relative to the first portion so as to provide an entrance angle of the propulsion member into the water that is substantially vertical and a second position wherein the second member is substantially radial relative to the hub means when the propulsion member is moved in the water.

In a further construction in accordance with the present invention, each propulsion member includes a biasing means for normally urging the second portion in the first position. Water resistance causes the second portion to straighten out in the second position against a restoring force exerted by the biasing means, thereby storing energy in the second position for further propelling the boat.

In a further construction in accordance with the present invention, the first and second portions are hingedly connected in an end-to-end relationship. The second portion is rotatable about a pivot axis substantially perpendicular to the radial axis of the first portion such that, in the second position, the second portion is substantially in line with the first portion.

In a further construction in accordance with the present invention, the biasing means includes a live hinge connecting the second portion to the first portion. Typically, the propulsion members are integrally molded from a polymeric material.

In a further construction in accordance with the present invention, each propulsion member includes stopper means to prevent the second portion from extending further than a straight plane. Each propulsion member has opposite leading and trailing surfaces and each stopper means includes first and second members extending respectively at right angle from the trailing surface of the first and second portions adjacent the pivot axis so that when the second portion is substantially in line with the first portion, the second member abuts against the first member, thereby preventing the second portion of the propulsion member from extending further than a straight plane. Generally, each propulsion member includes two stopper means uniformly distributed along the pivot axis.

In a further construction in accordance with the present invention, the second portion, in the first position thereof, extends at an angle of about 30 degrees relative to a projection of the radial axis of the first portion.

In a further construction in accordance with the present invention, the propulsion members are removably mounted to the hub means.

Typically, the hub means includes a central portion and a plurality of socket means extending radially therefrom for respectively receiving one of the propulsion members. Each propulsion member is provided at an inner radial end portion with a pair of spaced-apart inverted T-shaped fingers. Each finger is at least partly flexible and has an elongated member extending in a plane containing the first portion of the propulsion member and a projection extending perpendicularly through the plane. Each socket means includes a double wall portion adapted to receive therebetween at least a part of the inner radial end portion of one of the propulsion members. Each wall has notch means on either side thereof, whereby when one of the propulsion member is being mounted to one of the socket means, the inverted T-shaped fingers will respectively flex out on opposite sides of the walls to allow the projections to engage the notch means to thus secure the propulsion member to the socket means.

In a further construction in accordance with the present invention, each wall is provided with a flared ramp portion adjacent the notch means to facilitate the introduction of the projections in the notch means.

Typically, the inverted T-shaped fingers are respectively separated from the first portion of one of the propulsion members by radial slots defined in the inner radial end portion.

In a further construction in accordance with the present invention, each socket means includes a web partition extending perpendicularly and between the double wall portion. Accordingly, each propulsion member is provided at the inner radial end portion thereof with a central slot which extends along the radial axis for receiving the web partition when the propulsion member is mounted to the socket means.

Typically, a reinforcing member extends radially from the central portion of the hub means between each socket means.

In a further construction in accordance with the present invention, the hub means is integrally molded from a substantially rigid polymeric material.

In accordance with the present invention there is also provided a paddle wheel assembly for propelling a boat in water comprising a hub means having a central portion and a plurality of socket means extending radially therefrom for respectively receiving a propulsion member. The hub means is respectively coupled at each opposed end portion thereof to a crankshaft assembly. The hub means comprises a central portion which includes a generally cylindrical member having a longitudinal axis and at least two open ended end portions. Each crankshaft assembly includes a mounting adapter having a bore extending centrally therethrough along a longitudinal axis of the mounting adapter. The mounting adapter has a first end portion thereof disposed and dimensioned to slidably receive one end portion of the hub means for rotation therewith and a second end portion adapted to be securely engaged with a mounting end of a crankshaft. The crankshaft mounts pedals at offset portions thereof for allowing the paddle wheel assembly to be driven by foot. A fastening means extends axially through the mounting end, the bore and one of the open ended end portion of the cylindrical member to rigidly interconnect the crankshaft assembly and the hub means.

In a further construction in accordance with the present invention, each socket means of the hub means extends radially from an intermediate longitudinal portion of the cylindrical member and has a bottom edge projection extending in parallel relation with the longitudinal axis of the cylindrical member at a distance from an outer surface thereof. The first end portion of the mounting adapter has a substantially circular cross-section and an outer surface from which a plurality of pairs of spaced-apart ribs protrude so as to form a plurality of longitudinal channels. Each longitudinal channel is dimensioned and positioned to receive a portion of one of the bottom edge projections when one of the open ended end portions of the cylindrical member is slidably inserted in the first end portion of the mounting adapter, whereby the mounting adapter and the paddle rotate in unison.

Typically, each longitudinal channels defines a constricted entrance passage.

In a further construction in accordance with the present invention, the first end portion of the mounting adapter defines an axially extending annular groove for receiving therein one of the open ended end portion of the cylindrical member.

In a further construction in accordance with the present invention, the second end portion of the mounting adapter is adapted to receive thereon a bushing means which is interlockably engaged with a wall of the boat to which the paddle wheel assembly is mounted.

In accordance with a general aspect of the present invention, the second end portion of the mounting adapter is provided with a collar flange for restricting the axial displacement of the bushing means on the mounting adapter.

In a further construction in accordance with the present invention, the bushing means is provided with a plurality of longitudinally extending slots to permit water to flush particles of dirt or sand which can be present between the bushing means and the mounting adapter. In a more specific construction, the bushing means includes a tubular body having a circular cross-section and a collar protruding from one end thereof and the slots thereof includes a first set of slots adjacent the collar and a second set of slots extending from an opposed end of the tubular member. The first and second set of slots are in offset relation with respect to each other.

Typically, the mounting adapter and the bushing are integrally molded from a polymeric material. The crankshaft may be made of a rigid metallic material covered by a non-corroding material.

In a further construction in accordance with the present invention, the fastening means of the crankshaft assemblies includes a metal rod with threaded end portions which is inserted axially through the crankshaft mounting heads, the mounting adapters and into the hub means to threadably engage metal end fasteners to secure the crankshaft assemblies to the hub means.

In a still further construction in accordance with the present invention there is provided a pedal boat comprising an integrally molded hollow floating structure having an upper surface where at least one passenger can be seated, a steering assembly mounted to the hollow floating structure and at least one paddle wheel assembly also mounted to the hollow floating structure and adapted to be driven by foot to propel the pedal boat forward on a water surface.

In a further construction in accordance with the present invention, at least one drain conduit extends through the hollow floating structure. The drain conduit has inlet and outlet ends respectively defined in the upper surface and a lower surface of the hollow floating structure. The inlet end is disposed at a location which is above the surface of water when the pedal boat floats thereon, whereby the drain conduit can drain water away from the upper surface of the hollow floating structure.

In a further construction in accordance with the present invention, at least one drain groove is defined in the upper surface of the hollow floating platform to direct water outside of the hull.

In a further construction in accordance with the present invention, the hollow floating structure is provided with integral molded in handles and with integral molded in drink holders.

Moreover, an integral paddle box may be provided for each paddle wheel assembly to prevent the same from splashing water on the upper surface of the pedal boat when the paddle wheel assembly is activated in the water.

In a further construction in accordance with the present invention, the hollow floating structure defines a storage compartment. A lid is hingedly connected at one end thereof to the hollow floating structure to selectively close or open the storage compartment. A drain hole may communicate with the storage compartment to conduct water away therefrom.

In a further construction in accordance with the present invention, a steering assembly includes a steering handle having a protuberance extending downwardly therefrom through an aperture defined in the lid. A front steering arm is fixedly secured at a first end portion thereof to the protuberance and extends longitudinally and rearwardly along an inner surface of the lid. The steering assembly further comprises a rear steering arm having a pin means extending substantially at right angle from a first end portion thereof. The pin means is constrained to move in a slot defined in a second end portion of the front steering arm. The rear steering arm has a second opposed end portion which is connected to an upper end portion of a steering shaft which extends through a passage defined in the hollow floating structure. A rudder is fixedly secured to a lower end portion of the steering shaft. The second opposed end portion of the rear steering arm is hingedly secured to the first end portion thereof to allow the steering assembly to pivot with the opening of the lid.

In a further construction in accordance with the present invention, the protuberance of the steering handle defines a square recess which is adapted to receive therein a square peg protruding from the first end portion of the front steering arm. The protuberance and the square peg each having a hole extending therethrough for a fastener to pass through, the fastener being threadably engaged at one end thereof with a locking nut disposed underneath the front steering arm to retain the steering handle and the front steering arm in a secured assembly.

In a further construction in accordance with the present invention a screw extending through a washer means is threadably engaged with a screw hole defined in the pin means to couple the rear steering arm to the front steering arm.

In a further construction in accordance with the present invention, the upper end portion of the steering shaft has a dome-shaped head which is divided in two portions by a longitudinal slot extending therethrough along at least a portion of the length of the steering shaft. The second opposed end portion of the rear steering arm defines a circular aperture within which a pair of opposed ribs extend, the cylindrical aperture and the opposed ribs being dimensioned so as to enable the two portions of the dome-shaped head to flex inwardly when the upper end portion of the steering shaft is being inserted through the cylindrical aperture with the opposed ribs engaged in the longitudinal slot, whereby the two portions of the dome-shaped head flex out once past the circular aperture to join the steering shaft and the rear steering arm together.

According to a more specific construction, the slot extends centrally through the dome-shaped head so as to divide the dome-shaped head in two symmetrical portions and the pair of opposed ribs extending inwardly of the circular aperture of the rear steering arm extend in a diametrical direction.

In a further construction in accordance with the present invention, the steering shaft is provided with a removable annular ring which extends from the steering shaft above the passage defined in the hollow floating structure for restricting downward movements of the steering shaft relative to the hollow floating structure.

In a further construction in accordance with the present invention, the first end portion and the second opposed end portion of the rear steering arm are connected together by a live hinge.

In a further construction in accordance with the present invention, the steering handle, the front steering arm, the rear steering arm, the steering shaft and the rudder are all integrally molded from a polymeric material.

In a further construction in accordance with the present invention, the hollow floating structure is obtained by a rotational molding process.

In a further construction in accordance with the present invention, the pedal boat further includes at least one backrest which is pivotally and slidably mounted at one lower end portion thereof to a supporting rail connected at each end thereof to the hull and extending in a direction which is parallel to a longitudinal axis of the hull. The backrest includes an opposed lower end portion which can be selectively introduced in one slot means of a series of substantially vertically extending slot means defined in the hull along at least a portion of the longitudinal axis to secure the backrest in a functional position, whereby the backrest can be pivoted about the supporting rail to selectively engage or disengage the opposed lower end portion thereof from the slot means, thereby allowing the backrest to be slidably displaced on the supporting rail to adjust the position of the backrest.

In a further construction in accordance with the present invention, the backrest can be pivoted about the supporting rail outwardly of the hollow floating structure so as to permit someone to lie down on the upper surface thereof.

In a further construction in accordance with the present invention, the backrest is provided with at least one accordion-like portion capable of contraction to allow the backrest to flex rearwardly when pressure is exerted thereon.

The backrest may have a substantially inverted U-shape for improved ventilation and may be integrally molded from a polymeric material.

In a further construction in accordance with the present invention there is provided a pedal assembly for driving a wheel means. The pedal assembly comprises a crankshaft mounting pedals at offset portions thereof and having a connecting end secured to a mounting member at an offset location relative to a rotating axis of the crankshaft. The mounting member is adapted to receive a fastening means for attaching the crankshaft to a wheel means.

In a still further construction in accordance with the present invention, the integrally molded hollow floating structure is a one piece water impermeable polymeric member.

BRIEF DESCRIPTION OF THE DRAWINGS

Having thus generally described the nature of the present invention, reference will now be made to the accompanying drawings, showing by way of illustration a preferred embodiment thereof and in which.

DESCRIPTION OF THE PREFERRED EMBODIMENTS

Figure 1:
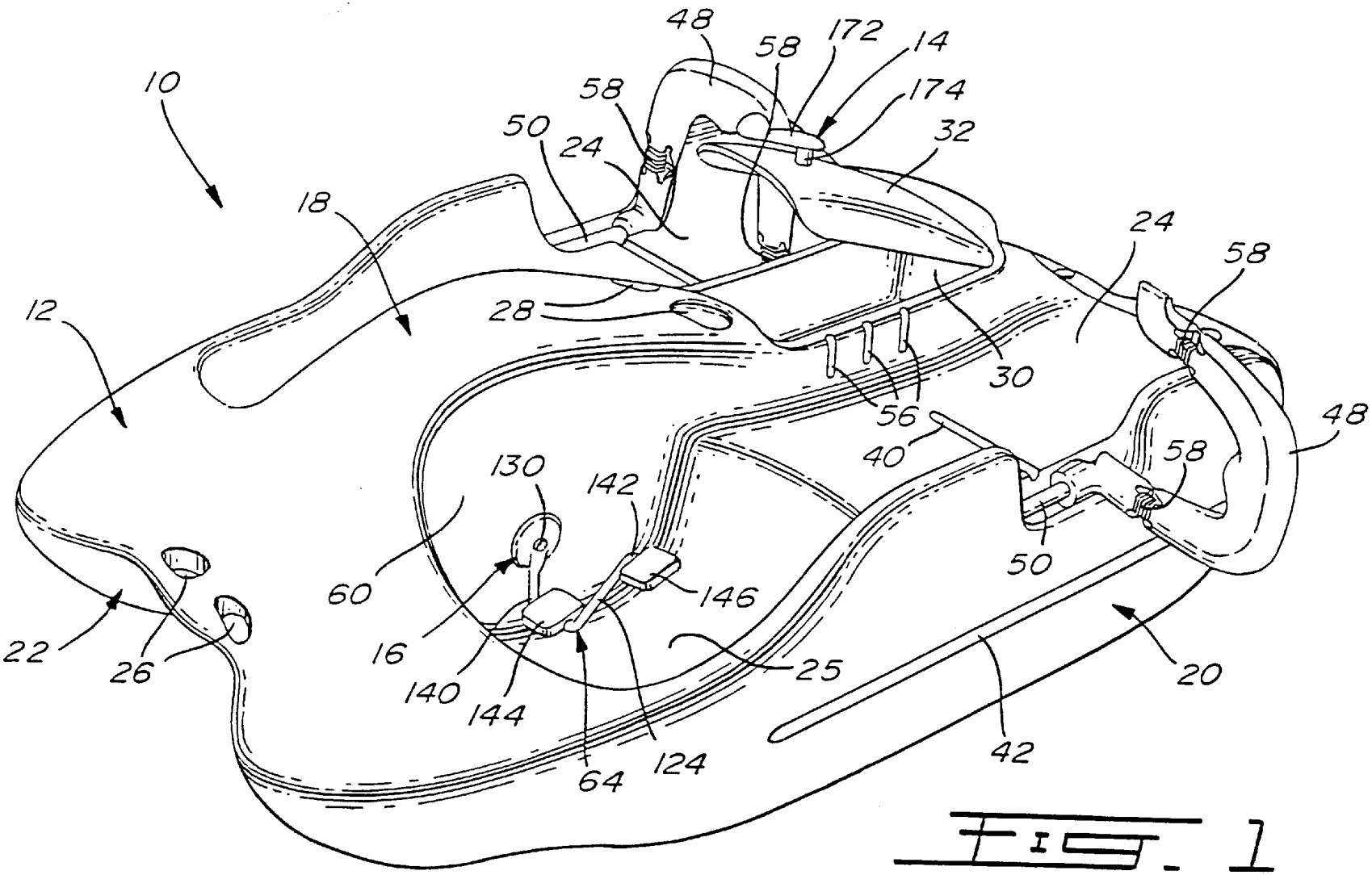
FIG. 1 is a perspective view of a pedal boat having a steering assembly and a paddle wheel assembly mounted thereto in accordance with the present invention.

In accordance with the present invention, FIG. 1 illustrates a pedal boat 10 comprising a hull 12, a steering assembly 14 and a paddle wheel assembly 16 adapted to be powered by foot to propel the pedal boat 10 forward on a water surface.

More specifically, the hull 12 consist of a hollow floating structure which is integrally molded from a polymeric material. According to a preferred embodiment of the present invention, the hull 12 is obtained by a rotational molding process. By having a seamless unitized hull construction, the possibilities that water enters inside of the hollow hull 12 are eliminated. This, furthermore, contributes to increase the integrity and durability of the hull 12.

Figure 4:
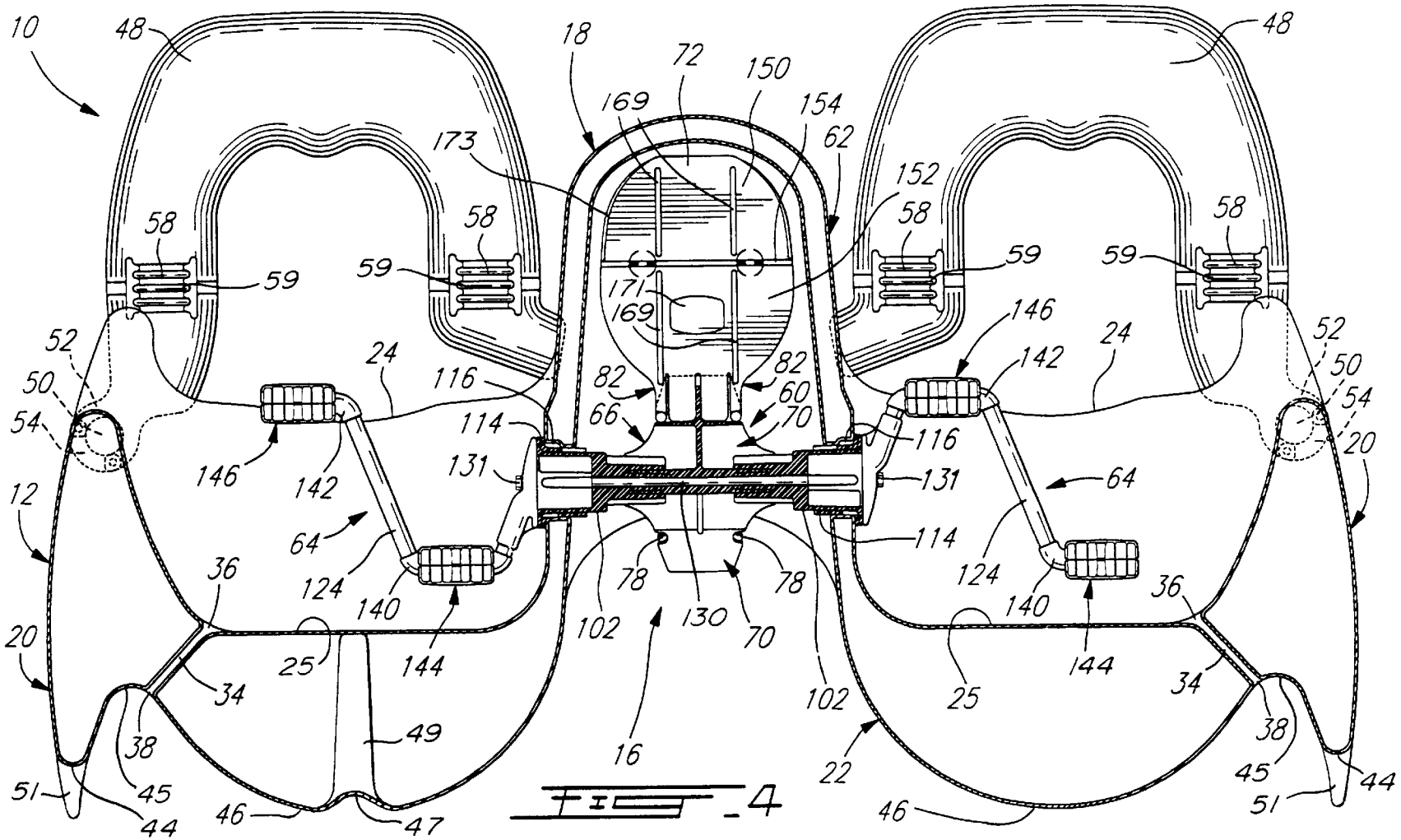
FIG. 4 is a transverse cross-sectional view taken along lines 4—4 of FIG. 3 illustrating how the paddle wheel assembly, comprised of two crankshaft assemblies and a paddle wheel, is mounted to the pedal boat.

As seen in FIG. 4, the hull 12 is provided with an upper surface 18, side surfaces 20 and a lower surface 22. The upper surface 18 defines a pair of side seats 24 which are respectively adapted to support one or two passengers. A well 25 is located immediately forward of the seat 24 in order to accommodate the passengers feet. In the event that two passengers are seated on one side of the hull 12 in a seat 24, the rear passenger may be seated back to back with the first passenger. The front passenger is in a position to power the paddle wheel assembly 16. Accordingly, only the two passengers seated side by side in front can power the paddle wheel assembly 16 simultaneously.

Figure 2:
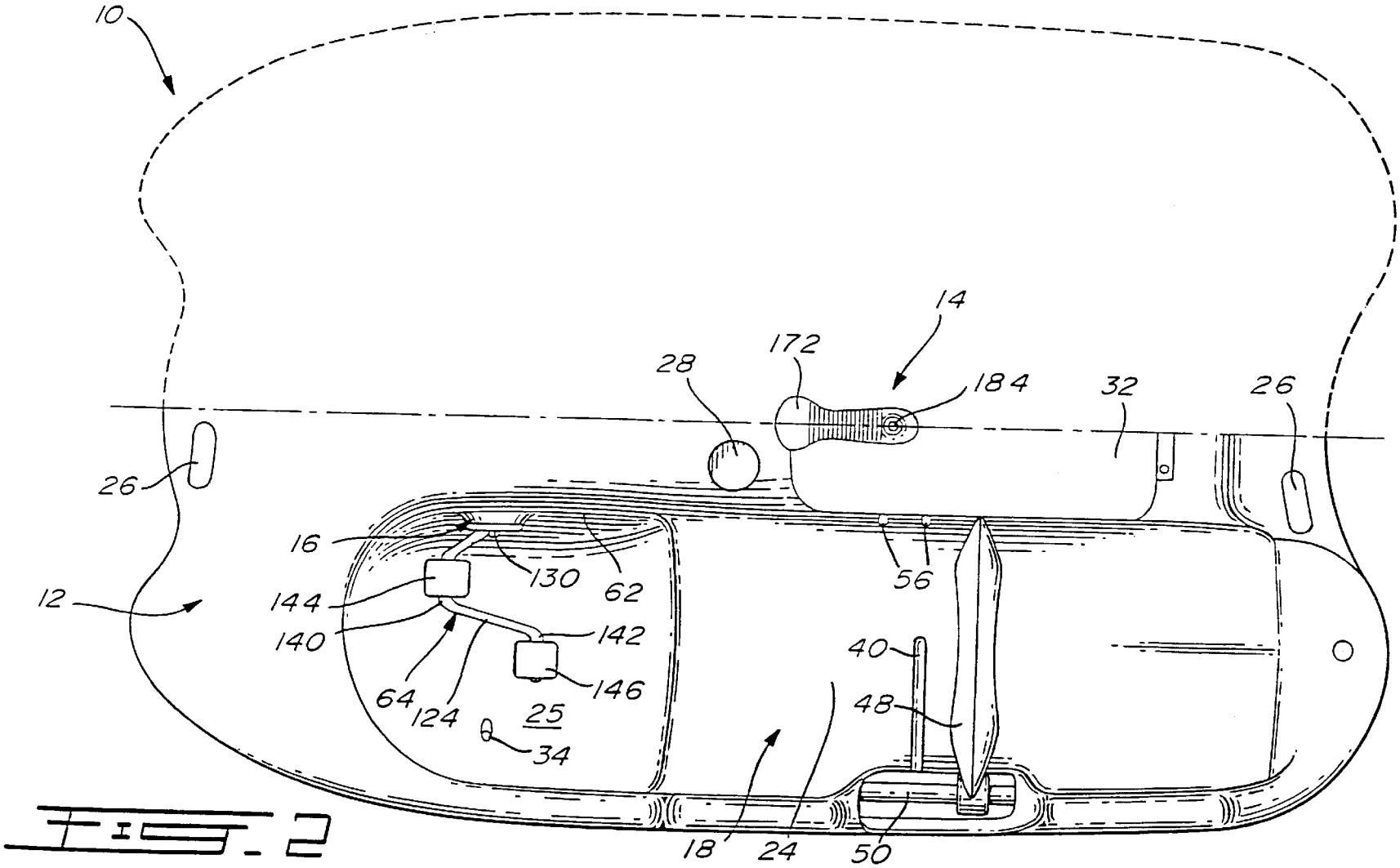
FIG. 2 is a top plan view of the pedal boat.

As best seen in FIGS. 1 and 2, the hull 12 is provided at the front and at the rear thereof with integral handles 26 which can be used for carrying the pedal boat 10 or, alternatively, for docking the same to a quay or the like.

Two drink holders 28 and a storage compartment 30 are defined in the upper surface 18 of the hull between the two seats 24. A lid 32 is hingedly secured at a rear end thereof to the hull 12 to selectively close or open the storage compartment 30.

As seen in FIG. 4, the well 25 is provided with drain conduits 34 which extend through the hollow structure of the hull 12 for drawing water away from the well 25 in pedal boat 10. More particularly, each drain conduit 34 has inlet and outlet ends 36 and 38. The inlet end 36 of each drain conduit 34 is disposed at a location which is above the surface of water when the pedal boat 10 is used. As shown in FIGS. 1 and 2, each seat 24 is provided with a drain groove 40 which is adapted to direct water outside of the hull 12. Accordingly, such a self-bailing hull designed has an interesting advantage in that it permits the use of the pedal boat 10 without ever having to bail water manually out of the pedal boat 10 after a rainstorm. Furthermore, as the hull 12 drains water instantly, the pedal boat may be used on the ocean in the waves. It is also noted that the storage compartment 30 may be provided with a drain conduit (not shown) to drain water such as melted ice.

Figure 3:
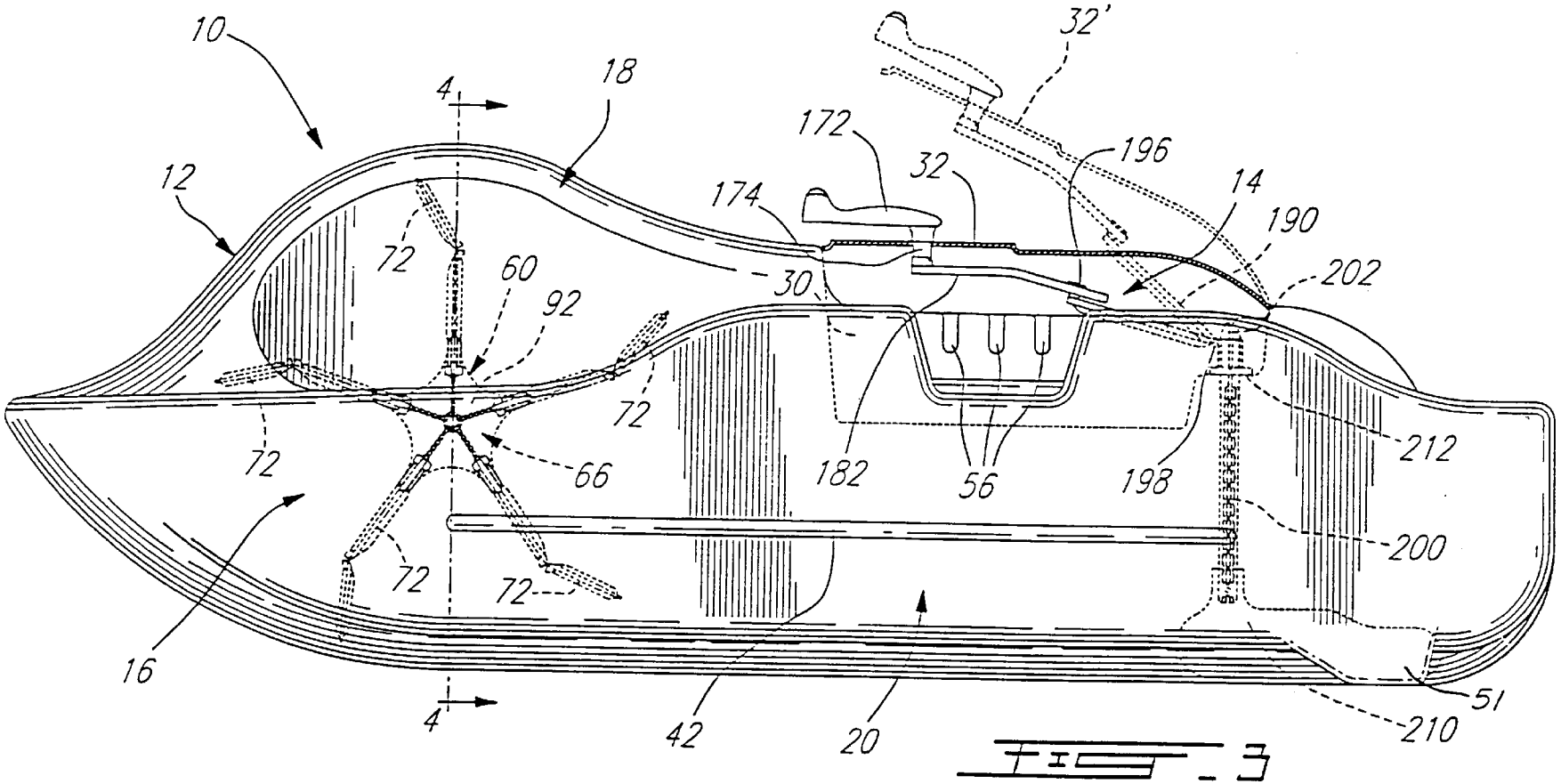
FIG. 3 is a side elevational view of the pedal boat showing, in dotted lines, the location of the paddle wheel assembly and the steering shaft assembly with respect to the pedal boat.

As seen in FIGS. 1 and 3, each side surface 20 of the hull 12 is formed with an integral longitudinal guard 42 for absorbing at least part of the shock which can arise when the side surfaces 20 enter in collision with a quay or the like.

Referring now to FIG. 4, it can be seen that the lower surface 22 of the hull 12 includes two minor convexly curved portions 44 extending along each side thereof and two major convexly curved portions 46 extending longitudinally therebetween, thereby defining a catamaran with outriggers, i.e. the convexly curved portions 44, which provides an improved tracking of the pedal boat in the water. An inverted channel 45 or concave portion extends between each pair of minor and major convexly curved portion 44 and 46. It is noted that the inverted channels 45 contribute to increase the hull rigidity.

It has been contemplated to define a minor inverted channel 47 longitudinally and centrally of each major curved portion 46 to increase the structural rigidity thereof.

It has also been contemplated to provide each major convexly curved portion 46 with a support member in the form of a central tower 49 that extends upwardly from about a mid point of the major convexly curved portion 46 associated therewith. The central towers 49 are respectively connected at an upper end thereof to a rear vertical wall of the wells 25. This structure provides additional structural rigidity to the major curved portions 46 to prevent flattening which reduces capacity and increases wetted surface slowing the pedal boat 10 and also decreasing tracking performance.

The outriggers act as stabilizers for the pedal boat 10 and contribute to increase tracking performance. Each minor curved portion 44 or outrigger is provided at a rear most portion thereof with a fin 51 extending downwardly therefrom to further enhance directional stability.

The large volume of the hull 12, along with the configuration thereof provides excellent buoyancy. Indeed, the hull 12 has a floatation capacity of about 1000 lb.

As best seen in FIGS. 1, 2 and 4, two adjustable backrests 48 are respectively pivotally and slidably mounted at a lower end thereof to a supporting rail 50 which is in turn integrally connected at each end thereof to the hull 12. Each supporting rail 50 extends longitudinally along a portion of the length of the hull 12. As shown in FIG. 4, each adjustable backrest 48 has a C-shaped end portion 52 which is dimensioned to receive therein one of the supporting rail 50. Once the C-shaped end portion 52 has been positioned over the supporting rail 50, two arcuate members 54 are respectively secured on each side of the C-shaped end portion 52 to form a closed loop around the supporting rail 50. Screws or other suitable fastener may be used to fasten the arcuate members 54 to the C-shaped end portion 52 of each adjustable backrest 48.

A series of three spaced-apart vertical slots 56 is defined in each side wall of the storage compartment 30 to respectively receive each of the two adjustable backrests 48 in three different operational positions along the longitudinal axis of the hull 12 for accommodating children to adult passengers. Accordingly, each adjustable backrest 48 can be pivoted about the corresponding supporting rail 50 thereof to selectively engage or disengage an opposed lower end thereof from one of the vertical slots 56, thereby allowing the adjustable backrest 48 to be slidably displaced on the supporting rail 50 associated therewith.

As illustrated in FIG. 1, the adjustable backrests 48 can be pivoted about the supporting rails 50 outwardly of the hull 12 so as to permit someone to lie down on the seats 24 formed on the upper surface 18 of the hull 12.

Each adjustable backrest 48 has a substantially inverted U-shape and is integrally molded from a polymeric material. As opposed to conventional continuous backrest, the U-shaped configuration allows the skin of the user to breathe, as only part of the user's back is in contact with the polymeric material.

Figures 7, 8:
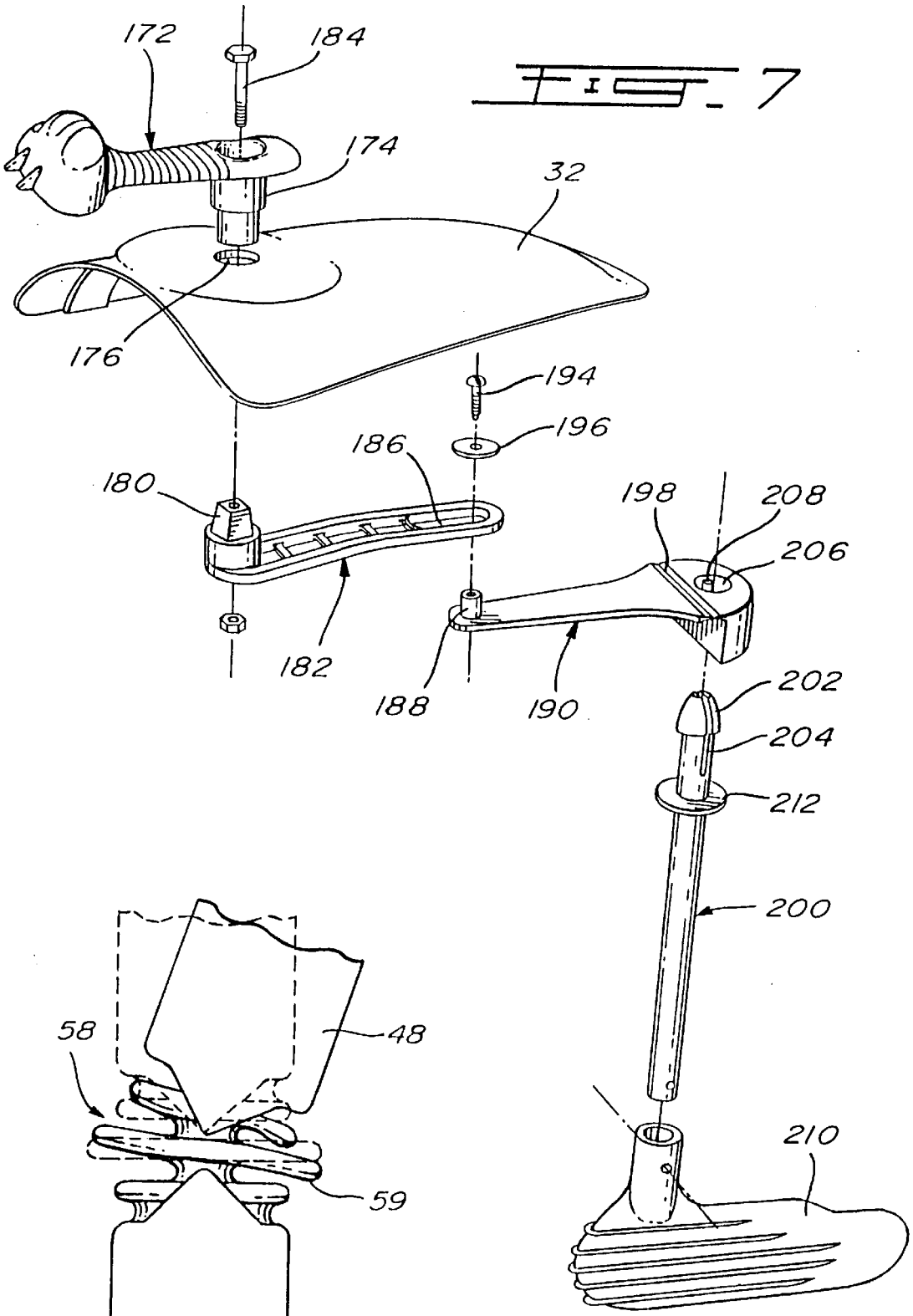
FIG. 7 is a perspective exploded view of the steering assembly.
FIG. 8 is an enlarged side elevational view of an accordion-like portion of a backrest of the pedal boat illustrating the operation thereof.

Furthermore, each leg of each inverted U-shaped adjustable backrest 48 is provided with an accordion-like portion 58. As best seen in FIG. 8, each accordion-like portion 58 is capable of contraction to enable the adjustable backrests 48 to flex rearwardly when pressure is exerted thereon by a passenger's back, thus providing more comfort. The central bellow 59 of each accordion-like portion 58 is wider, i.e. greater in dimension in a plane perpendicular to the plane of the backrests 48, and thus acts as a stopper. This prevent the central bellows 59 from popping inwardly when pressure is exerted thereon.

Referring now to FIGS. 3 to 6, it can be seen that the paddle wheel assembly 16 comprises a paddle wheel 60 which is mounted inside of a paddle box 62 to prevent the paddle wheel 60 from splashing water on the upper surface 18 of the hull 12 when the paddle wheel 60 is activated in the water. The paddle wheel 60 is respectively connected at opposed end portions thereof to two distinct crankshaft assemblies 64, thereby enabling the paddle wheel 60 to be simultaneously powered by two different passengers.

More particularly, the paddle wheel 60 includes a hub 66 having a central member 68 and five mounting sockets 70 extending substantially radially therefrom. Each mounting socket 70 is adapted to receive a paddle 72.

Figure 5:
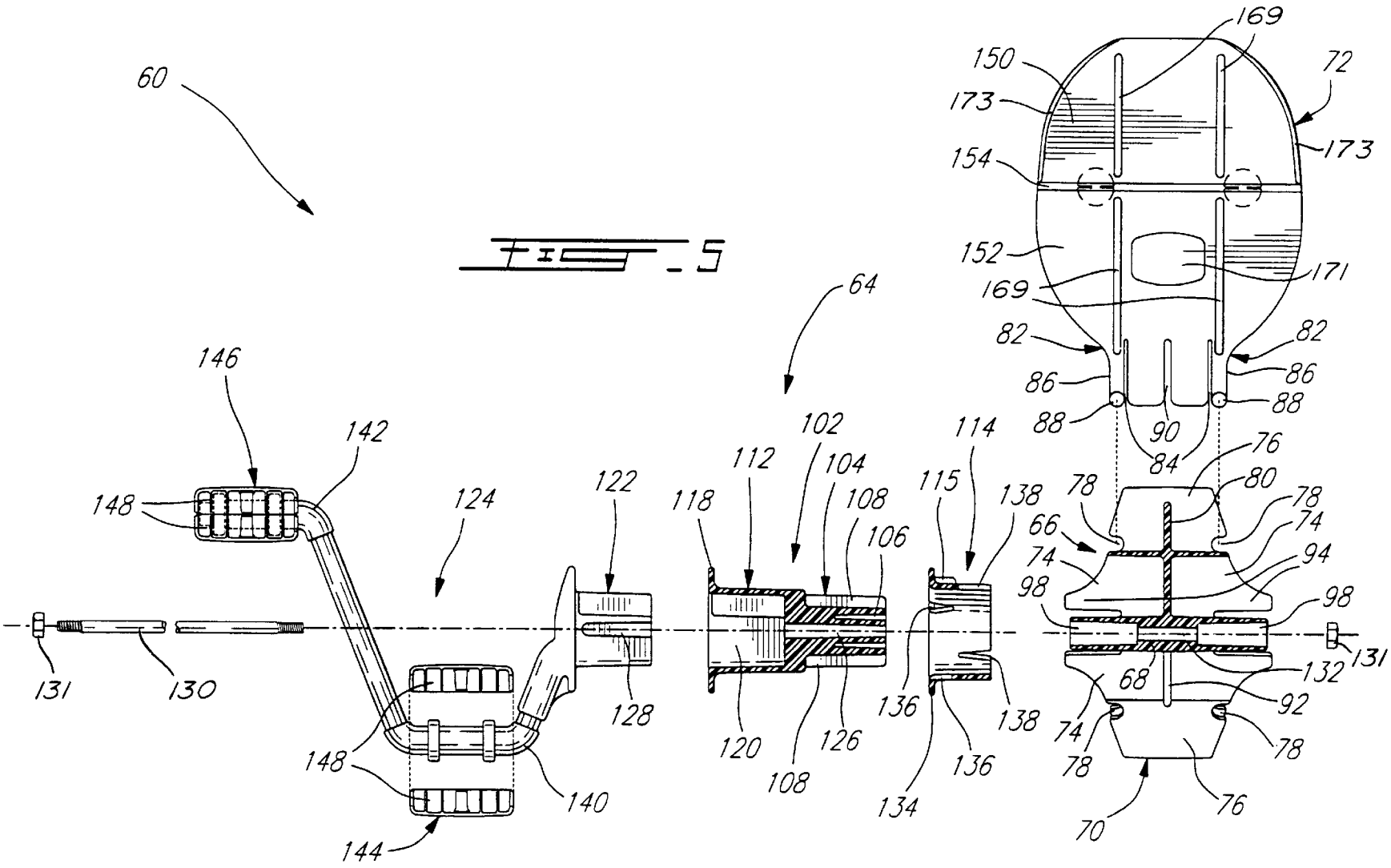
FIG. 5 is an exploded view of a portion of the paddle wheel assembly showing how one crankshaft assembly and the paddle wheel are assembled.

As illustrated in FIGS. 4 and 5, each mounting socket 70 comprises a single wall portion 74 which extends radially from an intermediate portion of the central member 68 of the hub 66. Each mounting socket 70 further comprises a double wall portion 76 with the walls extending in parallel fashion with respect to one another from an outer radial end of the single wall portion 74. Each wall of the double wall portion 76 has notches 78 on either side thereof with the notches 78 located on a same side being in alignment with each other, thereby forming two pairs of aligned notches. A web partition 80 extends perpendicularly between the double wall portion 76 of each mounting socket 70.

Each paddle 72 is provided at an inner radial end thereof with a pair of spaced-apart inverted T-shaped fingers 82 which are separated from the main body of the paddle 72 by slots 84. Each inverted T-shaped fingers 82 includes an elongated member 86 extending in a plane containing the paddle 72 and a projection 88 extending perpendicularly through this plane. Each paddle 72 further defines a central slot 90 extending longitudinally between the slots 84 and dimensioned to receive the web partition 80 when a paddle 72 is mounted to one of the mounting sockets 70.

Each individual paddle 72 are readily mounted to one of the mounting sockets 70 by pushing the inner radial end portion of the paddle 72 between the double wall portion 76, thereby causing the inverted T-shaped fingers 82 to flex out on opposed sides of the double wall portion 76, respectively, to thus permit the introduction of the projections 88 thereof in the notches 78. Accordingly, a damaged paddle can be easily replaced by a new one, without tools or without having to disassemble the paddle wheel 60 from the crankshaft assemblies 64.

To facilitate the insertion of the projections 88 inside of the notches 78, each double wall portion 76 is narrower at a radial outer end thereof than at a location adjacent the notches 78. The width of the walls gradually increases towards the notches 78, thereby forming a flared ramp portion which enables a gradual flexion of the inverted T-shaped members 82.

Figure 6:
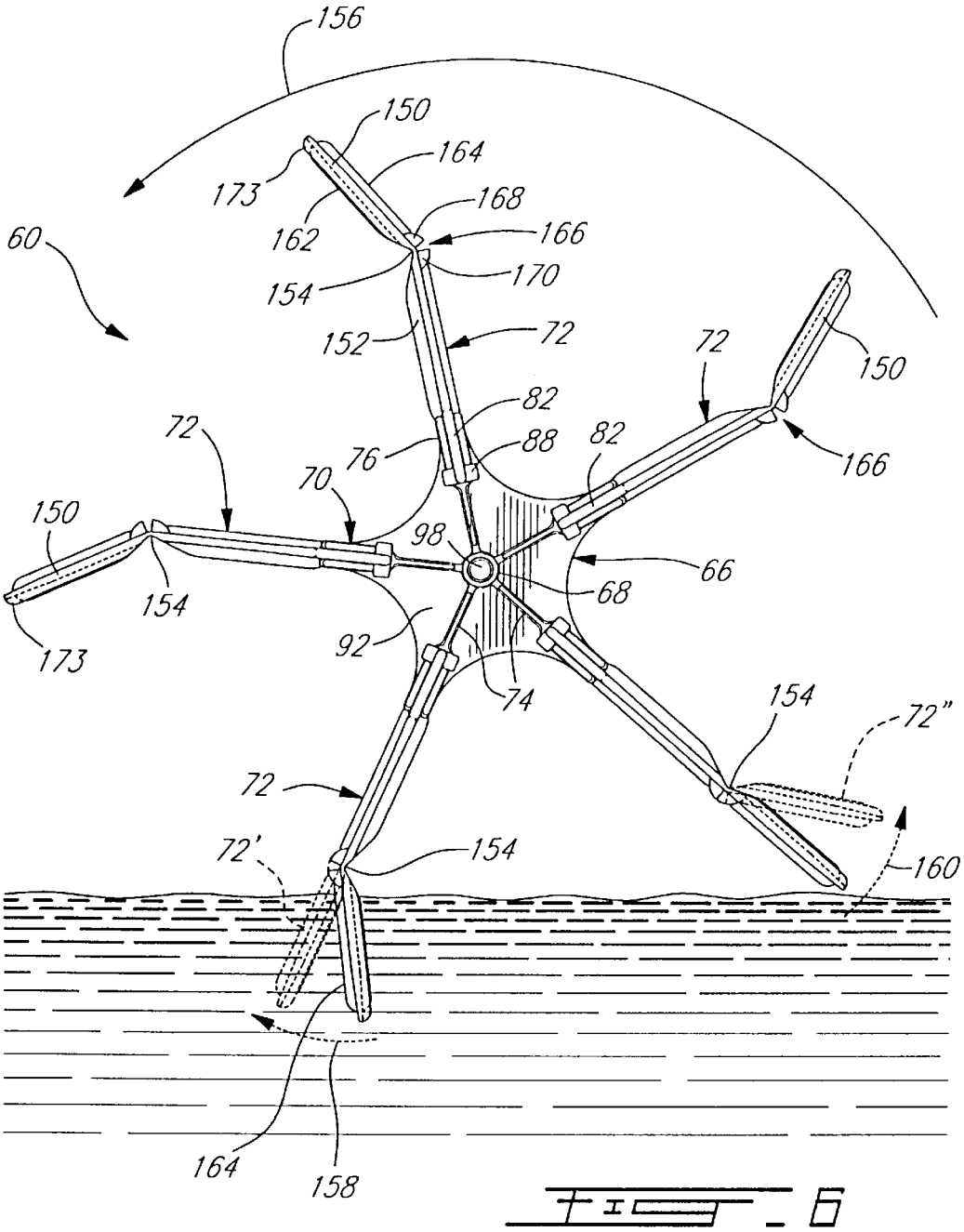
FIG. 6 is a side elevational view of the paddle wheel illustrating the operation thereof.

As best seen in FIGS. 5 and 6, an integral star-shaped reinforcing member 92 extends radially from the central member 68 of the hub 66 between the mounting sockets 70. According to a preferred embodiment of the present invention, the hub 66 is integrally molded from a substantially rigid polymeric material.

FIG. 5 illustrates how the paddle wheel 60 is mounted to a crankshaft assembly 64. It can be seen that the single wall portion 74 of each mounting socket 70 is provided with a bottom edge projection 94 which extends in parallel relation with the longitudinal axis of the central member 68 at a substantially constant distance from the periphery thereof. The central member 68 has a substantially cylindrical shape. Each end portion of the central member 68 defines a longitudinal circular bore 98 to receive therein a metal rod. Each crankshaft assembly 64 includes a mounting adapter 102 having a first end portion 104 thereof which defines an axially extending annular groove 106 dimensioned to slidably receive therein one end portion of the central member 68 of the paddle wheel 62. The first end portion 104 of the mounting adapter 102 has a substantially circular cross-section and an outer surface from which five pairs of spaced-apart ribs 108 protrude. Each pair of ribs 108 define therebetween a longitudinal channel which is adapted to receive therein one of the bottom edge projections 94 of the socket means 70 to thus ensure that the mounting adapter 102 and the paddle wheel 60 will rotate in unison. It is noted that each such longitudinal channel defines a constricted entrance passage.

The mounting adapter 102 includes a second end portion 112 which is adapted to receive thereon a bushing 114 which is in turn securely engaged in an opening 116 defined in a wall of the paddle box 62 of the hull 12. More specifically, the bushing 114 is provide on the periphery thereof with a key 115 which is adapted to engage a keyway defined in the wall of the paddle box 62 to thus ensure that the bushing 114 does not rotate in the opening 116. The second end portion 112 of the mounting adapter 102 is provided with an integral collar flange 118 to limit the axial displacement of the bushing 114.

The second end portion 112 of the mounting adapter 102 also defines a composite central recess 120 for receiving therein a mounting end 122 of a crankshaft 124. The configuration of the composite recess 120, along with the shape of the mounting end 122, ensure that the mounting adapter 102 and the crankshaft 124 will rotate conjointly. The composite recess 120 communicates with a central bore 126 extending through the first end portion 104 of the mounting adapter 102.

The mounting end 122 of the crankshaft 124 defines a central bore 128 which extends longitudinally therethrough. Therefore, when the mounting adapter 102 is engaged on the mounting end 122 of the crankshaft 124 and one end portion of the hub 66 is inserted in the first end portion 104 of the mounting adapter 102 as described hereinbefore, the central bore 126 of the mounting end 122, the central bore 128 of the first portion 104 of the mounting adapter 102 and the longitudinal circular bore 98 of the end portion of the central member 68 will be substantially aligned. Thus a rod 130 having threaded ends passes through the aligned longitudinal bores to threadably engage with nuts 131 at both ends, thereby rigidly interconnecting the crankshaft assemblies 64 and the hub 66.

As seen in FIG. 5, the point of connection between the mounting end 122 and the crankshaft 124 is off-center from the axis of rotation. The centering of the crankshaft 124 is achieved by the mounting end 122 which when assembled to the crankshaft 124 extends the latter into the center plane. The benefit of this arrangement is that both crankshaft assemblies 64 can be assembled with one central threaded rod 130. The crankshaft is typically made of steel and thus by offsetting the same, it is possible to eliminate the need for sophisticated drilling and welding of the crankshaft connecting end which normally interfere with a central mounting approach.

A circular bore 132 of reduced cros-cross-sectional area extends on the longitudinal axis of the central member 68 between the two longitudinal circular bores 98 for allowing the rod 130 to pass therethrough, as shown in FIG. 4.

The bushing 114 consist of a tubular body having a circular cross-section and a collar 134 protruding from one end thereof. As best seen in FIG. 5, the bushing 114 is provided with first and second series of longitudinal extending slots 136 and 138 which are respectively defined at opposed ends of the bushing 114 with a predetermined phase difference. The first and second series of longitudinal slots 136 and 138 enables water to remove particles of dirt or sand which can be present between the bushing 114 and the second end portion 112 of the mounting adapter 102.

It is noted that the mounting adapter 102 and the bushing 114 of each crankshaft assembly 64 are all integrally molded from a polymeric material.

The crankshaft 124 of each crankshaft assembly 64 comprises two offset portions 140 and 142 which are respectively adapted to receive first and second pedals 144 and 146 thereon. The first and second pedal 144 and 146 each comprises two associated cover members 148 which can be secured together over one of the offset portions 138 and 140 of the crankshaft 124 by integral snaps or the like. Each crankshaft 124 is made of a rigid metallic material covered by a non-corroding material, such as a polymeric material.

Having thus explained the mounting features of the paddle wheel assembly 16, there will now be described the construction and the operation of the paddles 72. As shown in FIGS. 5 and 6, each paddle 72 is molded from a flexible polymeric material and includes a terminal portion 150 which is connected to an inner radial end portion 152 of the paddle 72 by a live hinge 154. In its rest position, the terminal portion 150 is at about 30 degrees to the projection of the plane which contains the inner radial end portion of the paddle 72. Therefore, when the paddle wheel 60 is rotated counterclockwise, i.e. in the direction indicated by arrow 156 of FIG. 6, with the paddles 72 mounted thereon, the terminal portions 150 of the paddles 72 will enter the water at an angle close to 90 degrees. When each paddle 72 enters the water, the noise factor is reduced since the paddle 72 does not slap the surface of the water. In other words, the paddle 72 enters the water with much less surface area in the plane defined by the water surface compared to the case with straight radially mounted paddles.

When a paddle 72 is moved in the water, the terminal portion 150 thereof is displaced in the direction of arrow 158 to the phantom position 72' because the water resistance is greater than the biasing force of the live hinge 154. In the phantom position 72', the terminal portion 150 is substantially in line with the inner radial end portion 152 of the paddle 72. As the terminal portion 150 straightens out in the water, it is in contact with the water for a longer time, thereby providing a greater thrust to propel the pedal boat 10.

As soon as part of the terminal portion 150 of a given paddle 72 leaves the water, the pressure exerted on the terminal portion 150 becomes smaller than the biasing force of the live hinge 154 and thus the terminal portion 72 is automatically displaced in the direction of arrow 160 to its original position shown in phantom lines at 72", thereby providing an additional thrust to propel the pedal boat 10.

Accordingly, it can be said that the above described paddle construction makes the propulsion mechanism faster and quieter. Each paddle 72 has a leading surface 162 and a trailing surface 164. As shown in FIG. 6, stoppers 166 are provided on the trailing surface 164 of each paddle 72 to prevent the terminal end 150 thereof from extending further than a straight plane. More specifically, each stopper 166 comprises first and second members 168 and 170 extending respectively at right angle from the trailing surface 164 of the inner radial end portion 152 and the terminal portion 150 of one of the paddles 72 adjacent the pivot axis of the live hinge 154 thereof. Therefore, when the terminal portion 150 is substantially in line with the inner radial end portion 152, the second member 170 abuts against the first member 168, thereby preventing the terminal portion 150 of the paddle 72 from extending further than a straight plane.

According to a preferred embodiment of the present invention, there is two stoppers 166 per paddle 72. The stoppers 166 are uniformly distributed along the pivot axis of the live hinge 154.

Two pairs of parallel radial ribs 169 respectively extend from the leading and trailing surfaces 162 and 164 of the terminal portion 150 and the inner radial end portion 152 of each paddle 72 to increase the stiffness thereof. The inner radial end portion of each paddle 72 define a drainage hole 171 through which water may flow when the paddle 72 leaves the water surface.

As best seen in FIG. 5, two ribs 173 are respectively provided on opposed side edges of the terminal portion 150 of each paddle 72 to form a channel on the leading surface 162 thereof, thereby retaining the water on the leading surface 162 of the terminal portion 150 to thus increase the efficiency of the paddle 72.

As best seen in FIGS. 3 and 7, the steering assembly 14 is connected to the lid 32 of the storage compartment 30, thereby permitting easy access to facilitate maintenance or repair of the steering assembly 14. The steering assembly 14 comprises a steering handle 172 having a cylindrical protuberance 174 extending downwardly therefrom through an aperture 176 defined in the lid 32. The cylindrical protuberance 174 defines a square recess (not shown) at a free end thereof for receiving therein a square peg 180 extending integrally from a first end of a front steering arm 182. The cylindrical protuberance 174 and the square peg 180 each defines a longitudinal hole for a screw 184 to pass through. The screw 184 is threadably engaged with a locking nut located underneath the front steering arm 182 to thus secure the same to the steering handle 172.

The front steering arm 182 defines a longitudinal slot 186 at a rear end thereof to receive a cylindrical pin 188 protruding at substantially right angles from a first end portion of a rear steering arm 190. A screw 194 extending through a washer 196 disposed over the rear end of the front steering arm 182 is screwed in the center of the cylindrical pin 188 to connect the front steering arm 182 and the rear steering arm 190.

The rear steering arm 190 has a second end portion which is hingedly secured to the first end portion thereof by means of a live hinge 198. The second end portion of the rear steering arm 190 is connected to a steering shaft 200 having a dome-shaped head 202 which is divided in two equal portions by a longitudinal slot 204 extending centrally therethrough along a portion of the length of the steering shaft 200. The second end portion of the rear steering arm 190 defines a circular aperture 206 within which a pair of diametrically opposed ribs 208 extend.

The circular aperture 206 and the opposed ribs 208 are dimensioned to enable the two equal portions of the dome-shaped head 202 to flex inwardly when the steering shaft 200 is being inserted therethrough with the diametrically opposed ribs 208 engaged in the longitudinal slot 202. The two portions of the dome-shaped head 202 flex out once past the circular aperture 206 to prevent the steering shaft 200 from moving out of the rear steering arm 190. The steering shaft 200 extends downwardly through a passage defined in the hull 12 of the pedal boat 10 and is secured at a lower end thereof to a rudder 210 by a fastener (not shown). An removable annular ring 212 extends outwardly from the steering shaft 200 above the passage defined in the hull 12 for restricting downward movements of the steering shaft 200 relative to the hull 12.

In operation, the front steering arm 182 rotates conjointly with the steering handle 172 for pivoting the rudder 210 about a longitudinal axis defined by the steering shaft 200. The movement of rotation of the front steering arm 182 is transmitted to the steering shaft 200 by the slot and pin connection existing between the front and the rear steering arm 182 and 190.

As seen in FIG. 3, the live hinge 198 of the rear steering arm 190 allows the steering assembly 14 to be pivoted with the lid 32 of the storage compartment 30 between a closed position and an open position shown in phantom line at 32'.

It is noted that the steering handle 172, the front and the rear steering arms 182 and 190, the steering shaft 200 and the rudder 210 may all be integrally molded from a polymeric material. The steering handle 172 is designed so as to be conform to the hand of a user.

Figure 9:
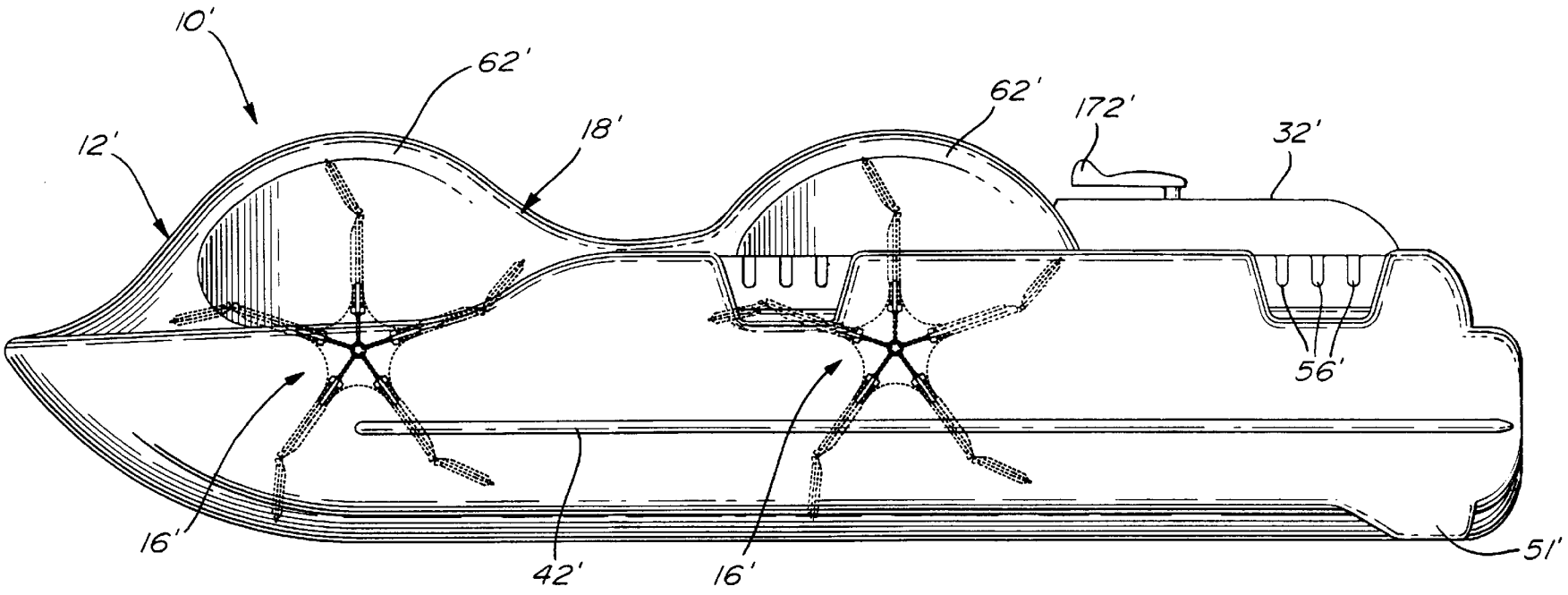
FIG. 9 is a side elevational view of a four passenger drive model of a pedal boat according to a second embodiment of the present invention showing, in dotted lines, the location of two paddle wheel assemblies and of a steering shaft assembly with respect to the pedal boat.

In accordance with a second preferred embodiment shown in FIG. 9, the pedal boat 10' is provided with two paddle wheel assemblies 16' for allowing four passengers to simultaneously drive the pedal boat 10'. The second paddle wheel assembly 16' is disposed behind the first one in a second paddle box 62'. Two additional seats and adjustable backrests are also provided.

I claim:

1. A paddle wheel for propelling a boat in water comprising a hub means and a plurality of propulsion members, each said propulsion member having a first portion thereof extending along a radial axis from said hub means and a second portion displaceable between a first position wherein said second portion extends at an angle relative to said first portion so as to provide an entrance angle of said propulsion member into the water that is substantially vertical and a second position wherein said second member is substantially radial relative to said hub means when said propulsion member is moved in the water.

2. A paddle wheel as defined in claim 1, wherein each said propulsion member includes a biasing means for normally urging said second portion in said first position, and wherein water resistance causes said second portion to straighten out in said second position against a restoring force exerted by said biasing means, thereby storing energy in said second position for further propelling said boat.

3. A paddle wheel as defined in claim 2, wherein said first and second portions are hingedly connected in an end-to-end relationship, said second portion being rotatable about a pivot axis substantially perpendicular to said radial axis of said first portion such that, in said second position, said second portion is substantially in line with said first portion.

4. A paddle wheel as defined in claim 3, wherein said biasing means includes a live hinge connecting said second portion to said first portion.

5. A paddle wheel as defined in claim 4, wherein said propulsion members are integrally molded from a polymeric material.

6. A paddle wheel as defined in claim 3, wherein each said propulsion member includes stopper means to prevent said second portion from extending further than a straight plane.

7. A paddle wheel as defined in claim 6, wherein each said propulsion member has opposite leading and trailing surfaces, and wherein each said stopper means includes first and second members extending respectively at right angle from said trailing surface of said first and second portions adjacent said pivot axis so that when said second portion is substantially in line with said first portion, said second member abuts against said first member, thereby preventing said second portion of said propulsion member from extending further than a straight plane.

8. A paddle wheel as defined in claim 3, wherein said second portion, in said first position, extends at an angle of about 30 degrees relative to a projection of said radial axis of said first portion.

9. A paddle wheel as defined in claim 3, wherein said propulsion members are removably mounted to said hub means.

10. A paddle wheel as defined in claim 1, wherein said second portion is normally resiliently biased in said first position, and wherein water resistance causes said second portion to straighten out to said second position, whereby upon exiting the water, said water resistance is overcome by a restoring force urging said second portion to said first position.

11. A paddle wheel as defined in claim 1, wherein each said propulsion member has opposite leading and trailing surfaces, and wherein said leading surface of said second portion of each said propulsion member is provided with a pair of radial rib means respectively disposed on opposed sides of said second portion to retain water thereon.

12. A paddle wheel assembly for propelling a boat in water comprising a hub means having a central portion and a plurality of socket means extending radially therefrom for respectively receiving a propulsion member, each said propulsion member being provided at an inner radial end portion with a pair of spaced-apart inverted T-shaped fingers, each said fingers being at least partly flexible and having an elongated member extending in a plane containing said inner radial end portion of said propulsion member, and a projection extending perpendicularly through said plane, each said socket means including a double wall portion adapted to receive therebetween at least a part of said inner radial end portion of one of said propulsion members, each said wall having notch means on either side thereof, whereby when one of said propulsion member is mounted to one of said socket means, said inverted T-shaped fingers will respectively flex out on opposite sides of said walls to allow said projections to engage said notch means to thus secure said propulsion member to said socket means.

13. A pedal boat comprising an integrally molded hollow floating structure having an upper surface where at least one passenger can be seated, said integrally molded hollow floating structure being of a seamless unitized construction, a steering assembly mounted to said hollow floating structure and at least one paddle wheel assembly also mounted to said hollow floating structure and adapted to be driven by foot to propel said pedal boat forward on a water surface.

14. A pedal boat as defined in claim 13, wherein at least one drain conduit extends through said hollow floating structure, said drain conduit having inlet and outlet ends respectively defined in said upper surface and a lower surface of said hollow floating structure, said inlet end being disposed at a location which is above the surface of water when said pedal boat floats thereon, whereby said drain conduit can drain water away from said upper surface of said hollow floating structure.

15. A pedal boat as defined in claim 13, wherein said hollow floating structure is provided with an integral paddle box for each said paddle wheel assembly to prevent the same from splashing water on said upper surface of said pedal boat when said paddle wheel assembly is activated in the water.

16. A pedal boat as defined in claim 13, wherein said hollow floating structure defines a storage compartment, and wherein a lid is hingedly connected at one end thereof to said hollow floating structure to selectively close or open said storage compartment.

17. A pedal boat as defined in claim 16, wherein said steering assembly includes a steering handle having a protuberance extending downwardly therefrom through an aperture defined in said lid, a front steering arm fixedly secured at a first end portion thereof to said protuberance and extending longitudinally and rearwardly along an inner surface of said lid, a rear steering arm having a pin means extending substantially at right angle from a first end portion thereof, said pin means being constrained to move in a slot defined in a second end portion of said front steering arm, said rear steering arm having a second opposed end portion which is connected to an upper end portion of a steering shaft which extends through a passage defined in said hollow floating structure, and a rudder fixedly secured to a lower end portion of said steering shaft, wherein said second opposed end portion of said rear steering arm is hingedly secured to said first end portion thereof to allow said steering assembly to pivot with said lid.

18. A pedal boat as defined in claim 13, wherein said pedal boat further includes at least one backrest which is pivotally and slidably mounted at one lower end portion thereof to a supporting rail connected at each end thereof to said hull and extending in a direction which is parallel to a longitudinal axis of said hull, said backrest having an opposed lower end portion which can be selectively introduced in one slot means of a series of substantially vertically extending slot means defined in said hull along at least a portion of said longitudinal axis to secure said backrest in a functional position, whereby said backrest can be pivoted about said supporting rail to selectively engage or disengage said opposed lower end portion thereof from said slot means, thereby allowing said backrest to be slidably displaced on said supporting rail to adjust the position of said backrest.

19. A pedal boat as defined in claim 18, wherein said at least one backrest is provided with at least one accordion-like portion capable of contraction to allow said backrest to flex rearwardly when pressure is exerted thereon.

20. A pedal boat as defined in claim 13, wherein said integrally molded hollow floating structure has an under surface which includes two lateral minor convexly curved portions respectively extending along opposed sides of said integrally molded hollow floating surface, each said lateral minor convexly curved portion merging with a concave portion inboard of said hollow floating structure, and two linked major convexly curved portions extending longitudinally on opposed sides of a central axis of said integrally molded hollow floating structure and merging with said concave portions to form a floating surface with said minor convexly curved portions.

21. A pedal assembly for driving a wheel means, comprising a crankshaft mounting pedals at offset portions thereof and having a connecting end secured to a mounting member at an offset location relative to a rotating axis of said crankshaft, said mounting member being adapted to receive a fastening means for attaching said crankshaft to a wheel means.

* * * * *